US005476177A

United States Patent [19]

Schmidt

[11] Patent Number: 5,476,177

[45] Date of Patent: Dec. 19, 1995

[54] SLUICE TRAP

[76] Inventor: Howard Schmidt, 1503 Graham Rd., Venice, Fla. 34293

[21] Appl. No.: 233,710

[22] Filed: Apr. 26, 1994

Related U.S. Application Data

[63] Continuation-in-part of Ser. No. 53,909, Apr. 27, 1993, Pat. No. 5,366,092, which is a continuation-in-part of Ser. No. 879,309, May 7, 1992, abandoned.

[51] Int. Cl.[6] ..... B03B 7/00

[52] U.S. Cl. ..... 209/13; 209/44; 209/159; 209/208; 209/506

[58] Field of Search ..... 209/13, 17, 44, 209/155, 156, 158, 160, 208, 209, 454, 506

[56] References Cited

U.S. PATENT DOCUMENTS

| | | | |
|---|---|---|---|
| 482,241 | 9/1892 | Gates | 209/158 |
| 727,974 | 5/1903 | Klein | 209/155 |
| 1,441,571 | 1/1923 | France | 209/158 X |
| 1,637,625 | 8/1927 | Shaw | 209/158 |
| 1,699,962 | 1/1929 | France | 209/18 |
| 1,865,167 | 6/1932 | Bongera | 209/17 X |
| 2,065,967 | 12/1936 | Clark et al. | 209/42 |
| 2,165,152 | 7/1939 | Pruss et al. | 209/158 |
| 3,291,304 | 12/1966 | Fuchs | 209/155 |
| 3,950,246 | 4/1976 | Klefisch | 209/44 |
| 5,255,787 | 10/1993 | Sims | 209/17 |
| 5,366,092 | 11/1994 | Schmidt, Sr. | 209/208 X |

FOREIGN PATENT DOCUMENTS

| | | | |
|---|---|---|---|
| 629799 | 11/1927 | France | 209/17 |
| 1312791 | 1/1962 | France | 209/158 |

OTHER PUBLICATIONS

Keene Engineering (catalogue) 1993 Spring–see apparatus on pp. 12, 18 and 31—examples of current state of the art—.

Gold prospector magazine, Mar. 1994, —copy of p. 76 (only).

*Primary Examiner*—William E. Terrell
*Assistant Examiner*—Tuan Nguyen
*Attorney, Agent, or Firm*—Pettis & McDonald

[57] ABSTRACT

A material classification device for separation of solid materials, having a relatively high specific gravity, from a stream of fluid and solid material. The device is particularly suited for the extraction of gold from alluvial material. The device generally comprises an open conduit that has a first opening and a second opening therethrough. A container is attached to the bottom of the conduit so that the openings are in fluid flow communication with the container. A portion of the flow of fluid and materials passes through the first opening and is captured in the container. A tube passes into the container with an aperture therein so that a fluid may be passed into the container to agitate the material collected therein freeing the lighter material so that it can exit the container out the second opening.

14 Claims, 4 Drawing Sheets

SLUICE TRAP

RELATED APPLICATIONS

This application is a continuation-in-part of my presently application Ser. No. 08/053,909, filed on Apr. 27, 1993 now U.S. Pat. No. 5,366,092, which was a continuation-in-part of a application Ser. No. 07/879,309, filed on May 7, 1992 now abandoned.

BACKGROUND OF THE INVENTION

1. Field of the Invention

The present invention relates to a material classification device that removes relatively heavy solid material from a stream of fluid and solid material. The device is particularly suitable for the extraction of gold from alluvial material. The solid materials are generally removed from the beds of bodies of water but may also be removed from above the water line and placed in a stream of fluid. The device, being small and generally lightweight, is suitable for use by a single individual by either placing the apparatus on the ground or partially submerging it in a body of water.

2. Description of the Prior Art

Many devices have been used over the years to separate materials that have a relatively high specific gravity from lighter materials. Sluice boxes, similar to that disclosed by the patent to George Gates, U.S. Pat. No. 482,241, are well known. Many of these devices contain various sieving and screening apparatus for classification of materials.

Frequently dredges are used to vacuum up material from the bottoms of rivers and lakes, which is then processed by large sluice boxes. The dredged fluid and material are passed over the sluice box classifier screens to separate the heavier solids from lighter solid material. Some classifier devices have ribbed constructions within the sluice box to capture the smaller relatively heavy particles.

U.S. Pat. No. 1,637,625, issued to E. Shaw, discloses another type of device that is used to clean and classify sand particles. The device uses a series of chambers to collect various sized particles.

Notwithstanding the current art, it remains clear that there is a need for a lightweight device that can be used by an individual to separate and capture the heavier desirable solid materials from lighter materials. In addition, the larger sluice boxes frequently are inefficient and fail to capture much of the heavier material, permitting that material to be washed through the sluice box to be lost as a part of the outflow. Therefore, it also remains clear that there is a need for an efficient device that can be used in conjunction with existing sluices and dredges to refine and separate the desirable material from the outflow of those dredges and sluice boxes.

SUMMARY OF THE INVENTION

The present invention relates to a device that separates a portion of the entrained solid materials from a stream of fluid. The material may be taken directly from stream beds, the beds of other bodies of water, or from sources of material above the water level. The device is particularly suitable for the separation of materials that have a relatively high specific gravity, such as gold, from those materials having a lower specific gravity. The device comprises an open conduit that has an interior, a bottom portion, an open inlet end, and an open outlet end. The bottom portion of the conduit has a first opening and a second opening passing therethrough. A container, comprising a hollow body having an interior, a bottom, at least one side, and an open top is attached to the bottom portion of the conduit. The rim of the open top is attached to the bottom portion of the conduit so that the container is in fluid flow communication with the conduit through both the first opening and the second opening.

The open conduit comprises an inlet portion that extends from the inlet end to the first opening, an outlet portion that extends form the outlet end to the second opening, and a mid portion that extends between the first and second openings. When material and fluid enter the inlet portion of the conduit, the material is moved by gravity, and/or by the force of the flow of the fluid, toward the mid portion of the conduit. The larger pieces of material can not pass through the first opening or the second opening and are carried by a portion of the fluid through the mid portion and out the outlet end. The smaller sized material is carried by the fluid through the first opening and into the container. The lighter materials, along with a portion of the fluid, pass from the container by exiting through the second opening into the outlet portion of the conduit and then exit the device from the outlet end.

The first end of at least one tube passes through one side of the container so that a portion of the tube extends into the container and the second open end remains outside the container. The portion of the tube that lies within the container has at least one aperture therein. Fluid passes through the open second end of the tube and enters the container through the aperture in the tube. This flow of fluid into the container agitates the material captured within the container to further separate the trapped lighter material from the heavier materials. These lighter materials are also removed from the container by the flow of fluid passing through the second opening into the conduit.

The solids collected in the container may be removed through a port in the bottom of the container. The port is closed during the operation of the device by a removable plug.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings. Different embodiments utilize reference characters that are incremented by multiples of 100.

DETAILED DESCRIPTION

Figure 5:
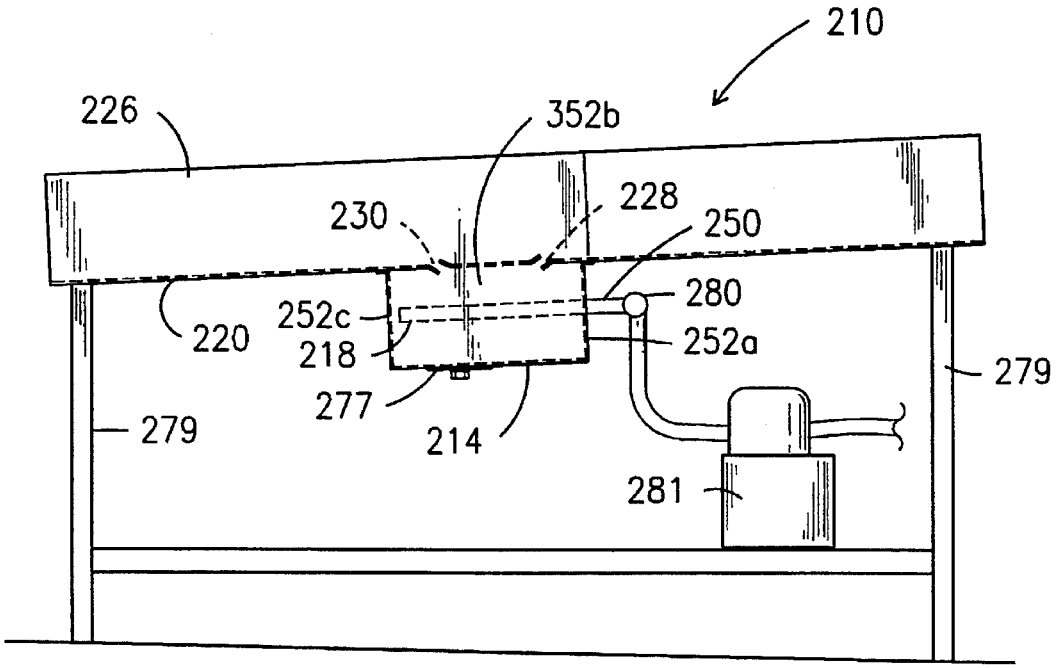
FIG. 5 is a left side elevational view of a second preferred embodiment of the device.
Figure 6:
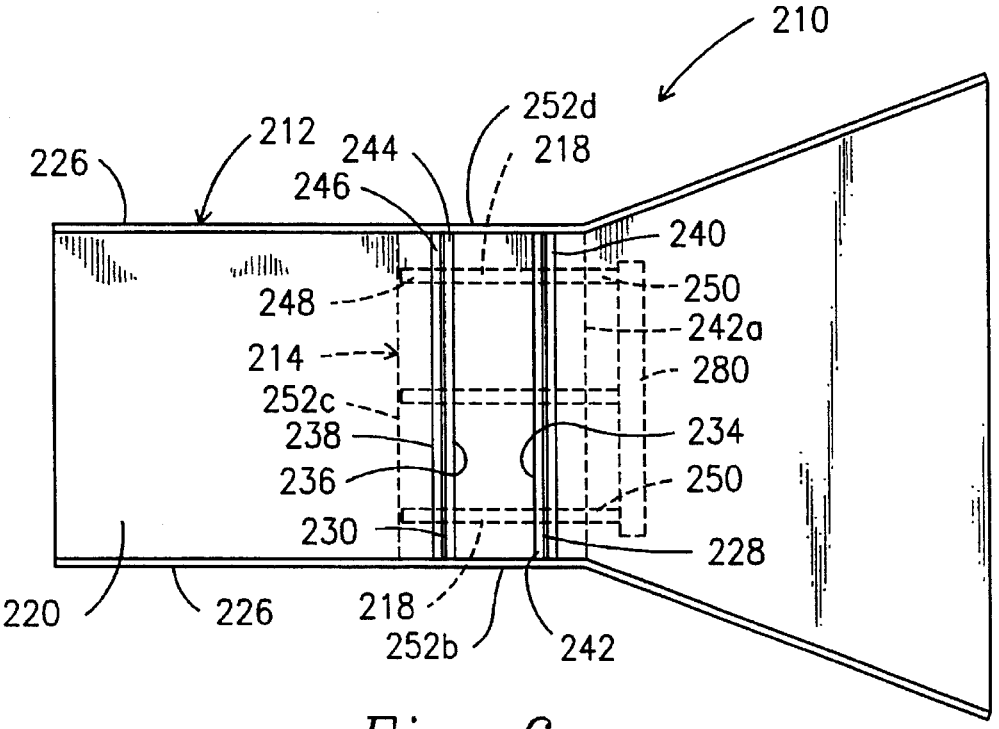
FIG. 6 is a top plan view of the device of FIG. 5.
Figure 7:
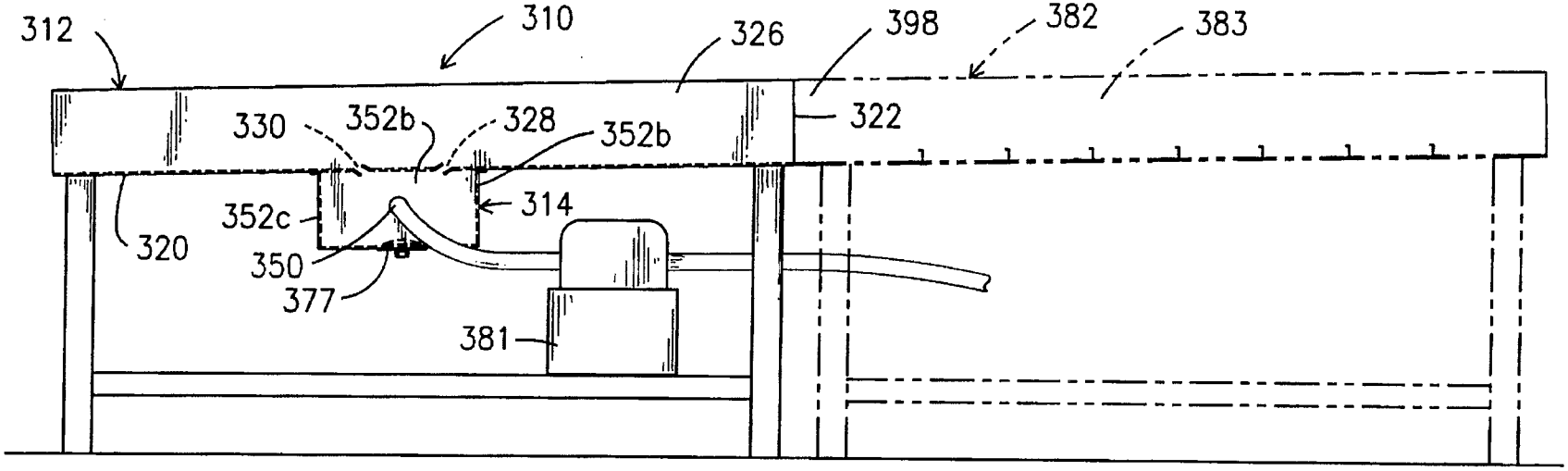
FIG. 7 is a left side elevational view of a third embodiment of the device illustrating its connection to an existing sluice shown in phantom.
Figure 9:
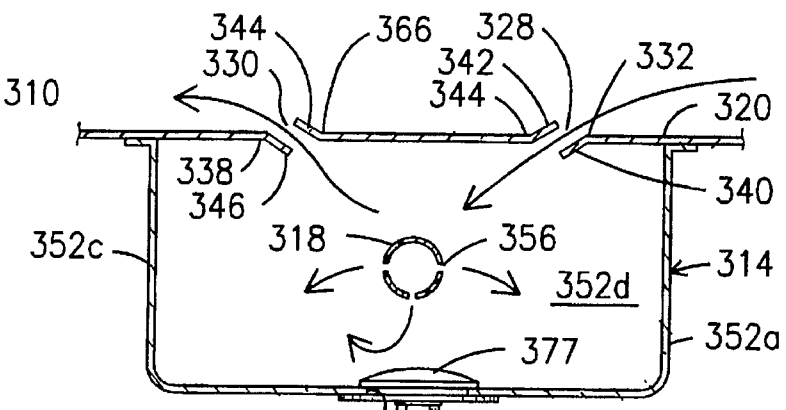
FIG. 9 is a cross sectional view taken along line 9—9 of FIG. 8.
Figure 8:
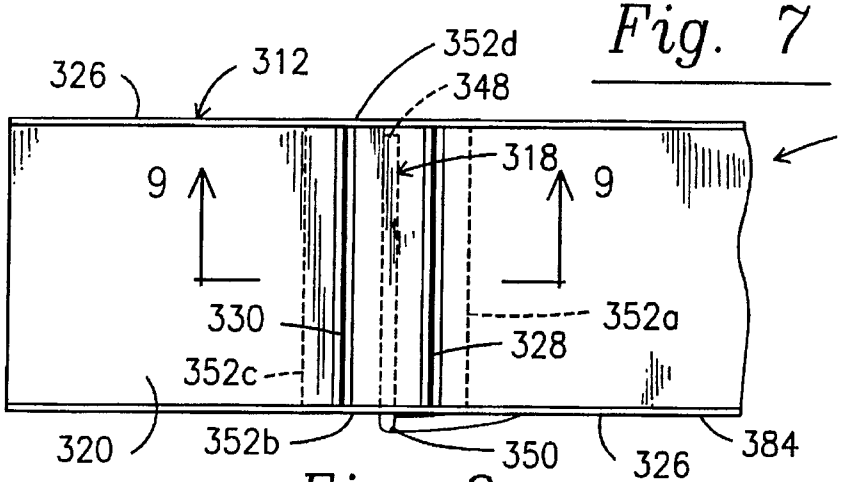
FIG. 8 is a partial top plan view of the device of FIG. 7.

A preferred embodiment of the device is illustrated in the drawing FIGS. 1–4, and generally indicated as 10. A second preferred embodiment of the device is illustrated in FIGS. 5 and 6, and is generally indicated as 210. A third preferred embodiment of the device is illustrated in FIGS. 7–9, and is generally indicated as 310.

Referring first to the view of FIGS. 1–4, it can be seen that this preferred embodiment of the device 10 comprises an open conduit, shown generally as 12, a container shown generally as 14, a scoop shown generally as 16, and a tube shown generally as 18.

Figure 1:
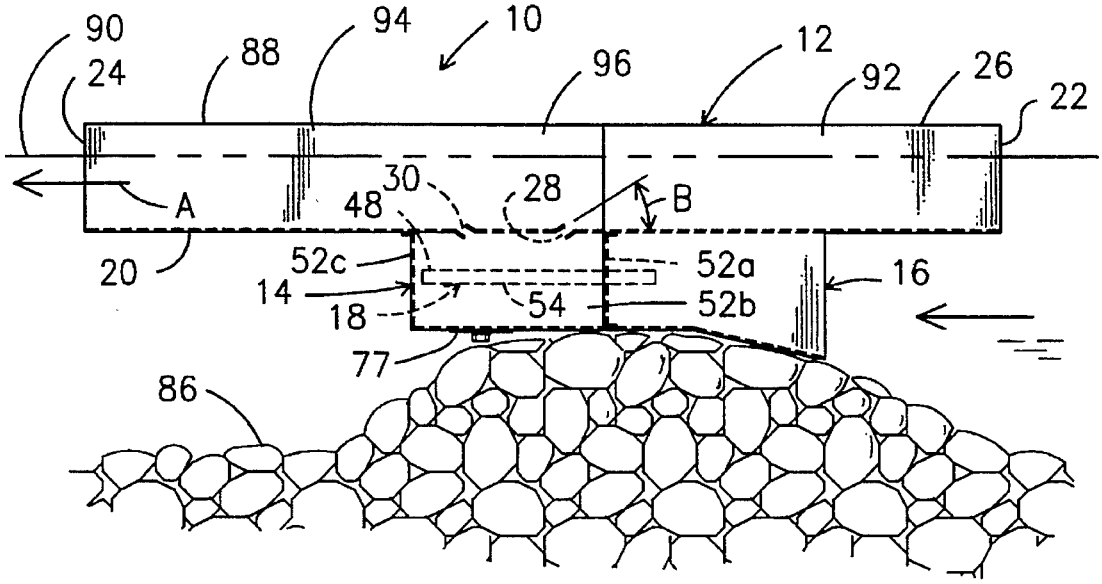
FIG. 1 is a left side elevational view of a preferred embodiment of the device, illustrating the device resting on a stream bed.
Figure 2:
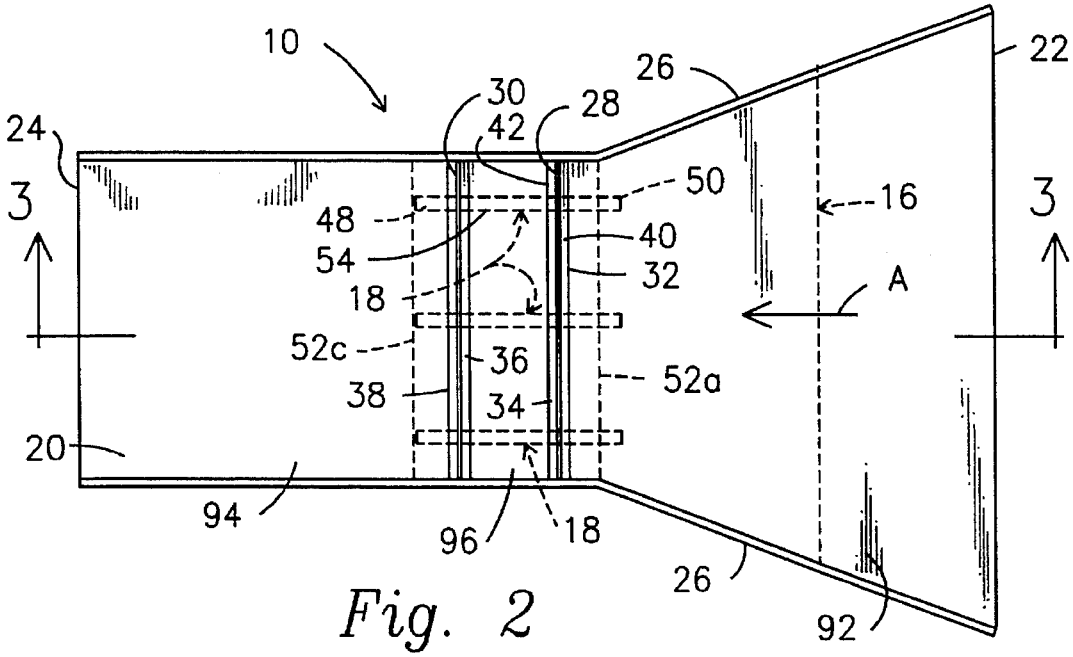
FIG. 2 is a top plan view of the device of FIG. 1.
Figure 3:
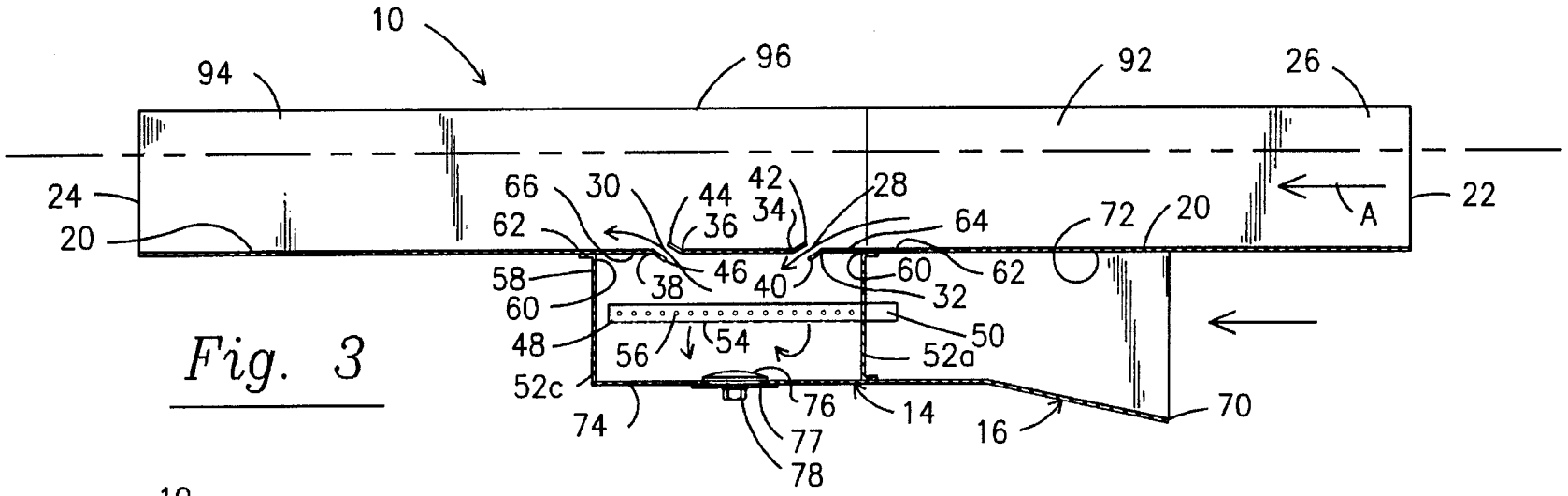
FIG. 3 is a cross sectional view taken along lines 3—3 of FIG. 2.
Figure 4:
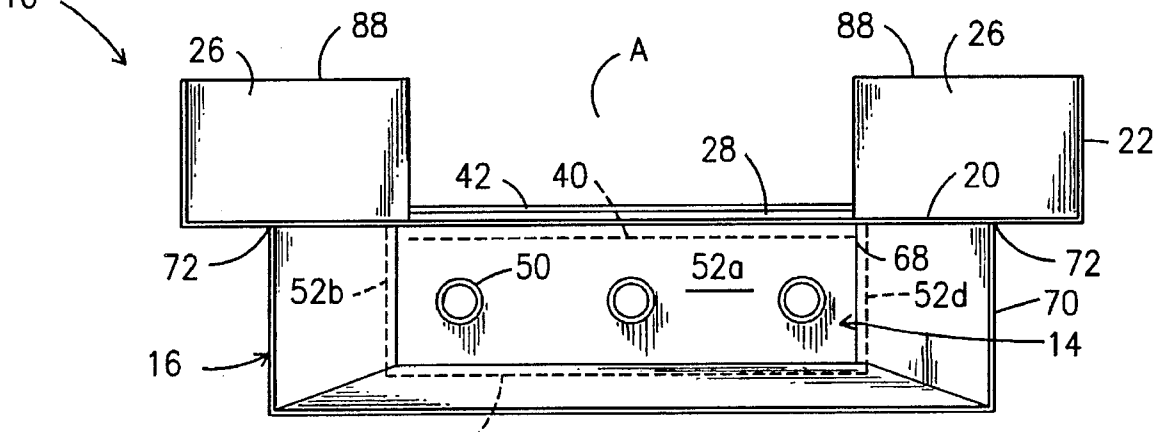
FIG. 4 is a front elevational view of the device of FIG. 1.

As seen more clearly in FIGS. 2 and 3, the open conduit 12 is comprised of a bottom portion 20, an open inlet end 22, and an open outlet end 24. In this embodiment, the bottom portion 20 of the conduit 12 is generally flat with a pair of opposed walls 26 extending upwardly therefrom. The bottom portion 20 has a first opening 28 and a second opening 30 passing therethrough. Each opening 28 and 30 is generally rectangular and extends transverse to the walls 26 of the conduit 12, extending across the bottom portion 20 to each wall 26. In other embodiments, the openings 28 and 30 may have different shapes to accommodate larger material or different flow patterns of fluid. As seen in FIG. 2, the first opening 28 has a first longitudinal edge 32 that is upstream of the first opening 28, with the direction of flow A being from the open inlet end 22 to the outlet end 24. The first opening 28 also has a second longitudinal edge 34 that is opposed to edge 32 and is downstream of the first opening 28. Similarly, the second opening 30 has a first longitudinal edge 36 on the upstream side of the second opening 30 and a second longitudinal edge 38 that is on the downstream side of the second opening 30. As seen in FIG. 3, a first flange 40 is attached to the first longitudinal edge 32, and in this embodiment extends longitudinally the full length of the first longitudinal edge 32. The first flange 40 extends downwardly into the container 14 and generally extends toward the second opening 30. A second flange 42 is attached to the second longitudinal edge 34 and extends longitudinal generally the full length of the longitudinal edge 34. The second flange 42 extends upwardly away from the second opening 30. A third flange 44 is attached to the first longitudinal edge 36 of the second opening 30 and extends longitudinal generally the full length of the first longitudinal edge 36 of the second opening 30. The third flange 44 extends upwardly and away from the first opening 28. A fourth flange 46 is attached to the second longitudinal edge 38 of the second opening 30 and extends generally longitudinally the full length of the second longitudinal edge 38 of the second opening 30. The fourth flange extends downwardly into the container 14 and toward the first opening 28. As seen in FIG. 1, each of the flanges 40, 42, 44, and 46 subtend an angle B from the plane defined by the bottom portion 20, which in this embodiment is approximately 30 degrees. The device 10 will operate satisfactorily if angle B lies between 20 and 40 degrees.

At least one tube 18, having a first end 48 and an open second end 50 is attached to the device 10. In a preferred embodiment illustrated by FIGS. 1–4, three tubes 18 are used. The first end 48 of each tube 18 passes through a side 52 of the container 14 (the structure of the container 14 is later explained) and extends into the container 14. The portion of the tube 54 that extends into the container 14 has at least one aperture 56 therein. While in other embodiments the single aperture 56 may comprise an open first end 48, in this preferred embodiment first end 48 is closed and a plurality of apertures 56 extend the length of that portion 54 of the tube 18 in the container 14. Preferably the apertures 56 are aimed laterally or downwardly so that the fluid passing through the apertures 56 is directed toward the material collected in the bottom of the container 14.

As best seen in FIG. 3, the container 14 has at least one side 52, and in this embodiment has four sides (52*a*–52*d*) with the tubes 18 penetrating side 52*a*. The open top 58 of the container 14 has a peripheral rim 60 which has a flange 62 extending therefrom for ease of attachment to the conduit 12. The portion of the rim 60 that is proximal to the first longitudinal edge 32 of the first opening 28 is spaced apart therefrom so that there is a first overhang portion 64 between the first opening 28 and the wall 52*a*. Similarly, the portion of the rim 60 that is proximal to the second longitudinal edge 38 of the second opening 30 is spaced apart therefrom to create a second overhang 66 between the second opening 30 and the wall 52*c*. The second overhang 66 is important to the operation of the device 10, because when the fluid and material enter the first opening there is a tendency for the fluid and material to move directly to the second opening 30 and immediately exit carrying some of the desirable material out of the container. The overhang 66 causes the flow to strike the side 52 and the overhang 66 and curl back against flange 46 where it is directed downwardly toward the center of the container 14. This gives the heavier material a greater opportunity to fall to the bottom of the container 14.

The scoop 16 has a first end 68, a second end 70 and a pair of top edges 72. The first end 68 of the scoop 16 is attached to the first side 52*a* of container 14. The scoop may be generally any size, but in the embodiment of FIGS. 1–4, the scoop is formed as a continuation of the walls 52*b*, 52*d* and the bottom 74 of the container 14. The second end 70 of the scoop is enlarged both transversely and vertically to provide an end cross section larger than a cross section proximal to the first end 68 of the scoop 16. The varying cross sections can be seen in FIG. 4 when comparing the second end 70 with the first end 68.

A port 76 is formed in the bottom 74 of the container 14 for removal of the material collected therein. A removable plug 77 is inserted into the port 76 to close the port 76 during operation of the device 10. The plug 77 may be any well known type of plug suitable for the purpose. In the embodiment disclosed in FIG. 3, the circumference of the plug 77 may be expanded or retracted by rotation of the bolt 78 for attachment to or removal from, respectively, the port 76.

FIGS. 5 and 6 illustrate a second embodiment of the device 10 wherein this embodiment is designated 210. The major differences between the structure of embodiment 210 and embodiment 10 are that embodiment 210 has no scoop 16, it is supported by legs 279 so that the device 210 can be situated on dry land and it has a manifold 280 and pump 281. When situated on dry land a fluid must be provided to the tubes 18 for agitation of the solids in the container 14. The second ends 250 of the tubes 218 are joined in fluid flow communication by the manifold 280. The pump means 281, conveniently any commercially available one (1) horsepower ¾ inch pump capable of providing a flow of about 500 gal/hour ore fluid, is attached in fluid flow communication to manifold 280 to provide a flow of fluid through each tube 18 and out the apertures 256. The fluid may comprise air, water or any other convenient fluid. Device 10 can be converted to device 210 by attaching legs 279, manifold 280, and pump 281. The scoop 16 may be removed or left attached.

A preferred embodiment 310 shown in FIGS. 7–9 varies only slightly from the second embodiment 210. In this embodiment, the device 310 is attached to an existing sluice box 382, shown in phantom in FIG. 7. Also, in embodiment 310, the walls 326 are generally longitudinally straight and are sized and configured so that the conduit 312 may be attached to the conduit 383 of the sluice box 382. A single tube 318 extends through wall 352*b* so that the tube extends transverse to the conduit 312. The second end 350 of the tube 318 is connected in fluid flow communication with a pump means 381. The pump means 381 may be any commercially available pump capable of providing a flow of 500 gallons per hour, conveniently a one (1) horsepower ¾ inch pump. As seen in FIG. 9, the tube 318 has a plurality of apertures 356 that are directed laterally and downwardly to agitate the materials collected in the container 14.

The device 10 may be constructed of any suitable metal, synthetic resin or any other suitable material. In a preferred embodiment the device 10 is constructed from aluminum to keep it strong and light weight. The legs 279 or 379 may also be made from wood to keep costs lower.

Having thus set forth a preferred construction for the device 10 of this invention, its method of operation may now be considered. As shown in FIG. 1–4, the conduit 12 further comprises an inlet portion 92, an outlet portion 94 and a mid portion 96. The inlet portion 92 includes the inlet end 22 and extends to the first opening 28. The outlet portion includes the outlet end 24 and extends to the second opening 30. The mid portion 96 extends from the first opening 28 to the second opening 30.

As shown in FIG. 1, the device 10 may be placed directly upon the bottom of a stream bed 86 so that the top edge 88 of each wall 26 extends above the water line shown in phantom as 90. The water flowing in the creek is then captured by the open inlet end 22 and moves through the open conduit 12 in the direction of flow A. As the water approaches the mid portion 96 of the conduit 12 the speed of the water increases due to the narrowing of the conduit 12. Solid material is taken from the stream bed and is placed in the inlet portion 92 of the conduit so that the stream of water carries it to the mid portion 96. The material is loosened and separated by the flow of water so that a portion of the fluid and a portion of the material that is small enough passes through the first opening 28 into the container 14. The remainder of the material is carried by the remainder of the fluid through the mid portion 96, the outlet portion 94, and out the outlet end 24 of the conduit 12. As the material and fluid enter the container 14, the flow strikes side 52*c*, the second overhang 66 and the fourth flange 46. The heavier material falls to the bottom and the lighter material is carried by the fluid out the second opening 30, into the outlet portion 94 and then out the outlet end 24.

As the material collects in the bottom of the container 14 much of the lighter weight material is trapped by the heavier material and retained. The scoop 16 funnels water from the stream into the second open ends 50 of the tubes 18. The water exits the tubes 18 by passing through the apertures 56. In a preferred embodiment, there is a plurality of apertures 56 opening downwardly and laterally into the container 14, as most clearly shown by FIG. 9 where the apertures are indicated as 356. The water is then directed generally downwardly striking the captured material and agitating it so that the lighter portions of the material are freed and carried away by the fluid as it exits through the second opening 30. The heavier, more desirable material is retained in the container 14. When the container begins to get full the device is removed from the stream, the nut 78 is loosened and the plug 77 is removed so that the material may be removed from the container 14 through the port 76. The plug 77 is then replaced and the operation continued.

In the second embodiment that is illustrated in FIGS. 5 and 6, the device 210 has been set along the shore or any other convenient location close to a source of material to be separated. Material is again placed in the inlet portion 92 of the open conduit 12. As there is no stream providing a water source, the water must be provided by a hose or other suitable means so that the water carries the material through the device 210. A second fluid supply must be provided to agitate the materials captured within the container 14. A manifold 280 is attached to the second ends 250 of the tubes 18. A pump 281 is attached in fluid flow communication with the manifold 280 and the pump 281 is also connected to a fluid source. A fluid, water, air or other suitable fluid, is pumped through the pump 281, through the manifold 280, into the tubes 218 and out the apertures 256. The device 210 now operates in a similar fashion to the device 10. Device 10 may be converted to the embodiment disclosed in 210 by adding legs 279, a manifold 280, and a pump 281. The scoop 16 may remain attached or may be removed as it is not needed.

The embodiment 310 disclosed in FIGS. 7, 8 and 9 is configured so that it may be attached to an existing sluice box, illustrated in phantom as 382. In this embodiment, the conduit 312 is configured so that it can be attached to the outlet end 398 of the sluice box 382. In this embodiment, the tube 318 does not have to be oriented in the direction of the flow of the stream as was done in device 10. Therefore, a single tube 318 extending, transversely to the conduit 312, through side 352*b*of container 314 provides adequate agitation to the materials contained within container 314.

The material and fluid that flow from the sluice box 382 enters the device 310 at the inlet end 322. The material is then separated in the same manner as in the first embodiment that was discussed previously.

It will thus be seen that the objects set forth above, among those made apparent from the proceeding description, are efficiently attained and, since certain changes may be made in the above article without departing from the scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which as a matter of language, might be said to fall there between.

Now that the invention as been described,

What is claimed is:

1. A device for separating a portion of entrained solid materials from a stream of fluid and material, said device comprising:

an open conduit having an interior, a bottom portion, an open inlet end, and an open outlet end, said bottom portion having a first opening therethrough and a second opening therethrough, and said conduit further comprising a mid portion extending between said first opening and said second opening, an inlet portion including said inlet end, and an outlet portion including said outlet end;

a container comprising a hollow body having an interior, a bottom, at least one side, and an open top, said open top being attached to said bottom portion such that said interior of said conduit is in fluid flow communication with said interior of said container through said first opening and said second opening, whereby a portion of a stream of fluid and material moving from said inlet end to said outlet end passes through said mid portion of said conduit and out said outlet end, and the remaining portion of the stream of fluid and material passes through said first opening, a portion of the material is captured in said container and the remaining portion of the fluid and material passes through said second opening and out said outlet end;

at least one tube having a first end and an open second end, said first end of said tube passing through said side of said container so that at least a portion of said tube extends into said container, said portion of said tube within said container having at least one aperture therein; and a scoop having a first end, a second end, said scoop being attached to said bottom portion of said conduit and said first end of said scoop being attached to said container such that said second end of said tube is in fluid flow communication with said scoop.

2. A device as in claim 1 wherein said first opening is generally rectangular extending generally transverse to said conduit, said first opening having a first longitudinal edge upstream of said first opening and a second longitudinal edge downstream of said first opening; said device further comprising a first flange, extending downwardly from said first edge of said first opening and extending toward said second opening.

3. A device as in claim 1 wherein said first opening is generally rectangular extending generally transverse to said conduit, said first opening having a first longitudinal edge upstream of said first opening and a second longitudinal edge downstream of said first opening; said device further comprising a second flange, extending upwardly from said second edge of said first opening and extending away from said second opening.

4. A device as in claim 1 wherein said second opening is generally rectangular extending generally transverse to said conduit, said second opening having a first longitudinal edge upstream of said second opening and a second longitudinal edge downstream of said second opening; said device further comprising a third flange extending upwardly from said first edge of said second opening and extending away from said first opening.

5. A device as in claim 1 wherein said second opening is generally rectangular extending generally transverse to said conduit, said second opening having a first longitudinal edge upstream of said second opening and a second longitudinal edge downstream of said second opening; said device further comprising a fourth flange extending downwardly from said second edge of said second opening and extending toward said first opening.

6. A device as in claim 1 wherein said tube has a plurality of apertures therethrough and at least one said aperture opens generally toward said bottom of said container.

7. A device as in claim 1 wherein said container further comprises at least one port through said bottom of said container and a means for closing and opening said port.

8. A device as in claim 1 wherein the cross sectional area defined by said first end of said scoop is less than the cross sectional area defined by said second end of said scoop.

9. A device as in claim 1 further comprising a pump means connected in fluid flow relationship to said second end of said tube, whereby a fluid is pumped through said tube and through said aperture in said tube into said container.

10. A device for separating a portion of entrained solid materials from a stream of fluid, said device comprising:

an open conduit having an interior, a bottom portion, an open inlet end, and an open outlet end, said bottom portion having a first opening therethrough and a second opening therethrough, said first opening have a first longitudinal edge upstream of said first opening and a second longitudinal edge downstream of said first opening, said second opening having a first longitudinal edge upstream of said second opening and a second edge downstream of said second opening, and said conduit further comprising a mid portion extending between said first opening and said second opening, an inlet portion including said inlet end, and an outlet portion including said outlet end;

a container comprising a hollow body having an interior, a bottom, at least one side, and an open top, said open top having a rim, said rim being attached to said bottom portion of said conduit such that said interior of said conduit is in fluid flow communication with said interior of said container through said first opening and said second opening, said portion of said rim proximal to said second edge of said second opening being spaced apart from said second edge of said second opening, whereby a portion of a stream of fluid and material passes through said mid portion of said conduit and out said outlet end, and the remaining portion of the stream of fluid and material moving from said inlet end to said outlet end passes through said first opening, a portion of the fluid and material is captured in said container and the remaining portion of the fluid and material passes through said second opening and out said outlet end;

at least one tube having a first end and an open second end, said first end of said tube passing through said side of said container so that at least a portion of said tube extends into said container, said portion of said tube within said container having at least one aperture therein; and a scoop having a first end, a second end, said scoop being attached to said bottom portion of said conduit and said first end of said scoop being attached to said container such that said second end of said tube is in fluid flow communication with said scoop.

11. A device as in claim 10 wherein said portion of said rim proximal to said first edge of said first opening is spaced apart from said first edge of said first opening.

12. A device as in claim 10 further comprising a pump means connected in fluid flow relationship to said second end of said tube, whereby a fluid is pumped through said tube and through said aperture in said tube into said container.

13. A device as in claim 10 wherein the cross sectional area defined by said first end of said scoop is less than the cross sectional area defined by said second end of said scoop.

14. A device as in claim 10 wherein said container further comprises at least one port through said bottom of said container and a means for closing and opening said port.

* * * * *